US010145385B2

(12) United States Patent
Guo et al.

(10) Patent No.: US 10,145,385 B2
(45) Date of Patent: Dec. 4, 2018

(54) PUMP

(71) Applicant: Johnson Electric S.A., Murten (CH)

(72) Inventors: Chuan Jiang Guo, Shenzhen (CN); Chuan Hui Fang, Hong Kong (CN); Hay Tak Tsang, Hong Kong (CN)

(73) Assignee: JOHNSON ELECTRIC S.A., Murten (CH)

( * ) Notice: Subject to any disclaimer, the term of this patent is extended or adjusted under 35 U.S.C. 154(b) by 555 days.

(21) Appl. No.: 14/284,211

(22) Filed: May 21, 2014

(65) Prior Publication Data

US 2014/0348675 A1 Nov. 27, 2014

(30) Foreign Application Priority Data

May 22, 2013 (CN) ..... 2013 1 0196437

(51) Int. Cl.

| | |
|---|---|
| ***F04D 29/42*** | (2006.01) |
| ***F04D 29/44*** | (2006.01) |
| ***F04D 13/06*** | (2006.01) |
| ***F04D 29/22*** | (2006.01) |
| ***F04D 29/48*** | (2006.01) |

(52) U.S. Cl.

CPC ..... *F04D 29/4293* (2013.01); *F04D 13/06* (2013.01); *F04D 29/2255* (2013.01); *F04D 29/2277* (2013.01); *F04D 29/445* (2013.01); *F04D 29/448* (2013.01); *F04D 29/486* (2013.01); *F04D 29/2288* (2013.01)

(58) Field of Classification Search

CPC .. F04D 13/06; F04D 29/2277; F04D 29/2288; F04D 29/4293; F04D 29/448; F04D 29/486; F04D 29/445; F04D 1/063; F04D 29/086

See application file for complete search history.

(56) References Cited

U.S. PATENT DOCUMENTS

| | | | | |
|---|---|---|---|---|
| 5,180,280 | A * | 1/1993 | Honda | F04D 29/2255 415/182.1 |
| 5,181,838 | A * | 1/1993 | Sato | B60S 1/481 417/360 |
| 5,320,489 | A * | 6/1994 | McKenna | F04D 29/448 415/199.1 |
| 6,198,189 | B1 * | 3/2001 | Takahashi | F04D 13/06 310/405 |
| 7,407,321 | B1 * | 8/2008 | Renfro | B01F 7/1695 366/251 |

(Continued)

*Primary Examiner* — Dominick L Plakkoottam

(74) *Attorney, Agent, or Firm* — Muncy, Geissler, Olds & Lowe, P.C.

(57) ABSTRACT

A liquid pump has a pump housing defining a pump chamber. A motor is accommodated within the pump housing and separated from the pump chamber by an end cap. An impeller disposed within the pump chamber is driven by the motor. The pump chamber has an inlet and one or more outlets. The outlets are located on a sidewall of the pump chamber and extend in a direction substantially tangential to an outer circumference of the pump chamber. Each outlet has a first end near the pump chamber, and a second end remote from the pump chamber. A cross-sectional area $S_1$ of the first end is smaller than a cross-sectional area $S_2$ of the second end, forming a diffuser within the outlet.

16 Claims, 9 Drawing Sheets

(56) References Cited

U.S. PATENT DOCUMENTS

2004/0179949 A1* 9/2004 Duran ..... F04D 1/063
417/244
2013/0175764 A1* 7/2013 Hamamoto ..... F16J 15/3232
277/562
2013/0177451 A1* 7/2013 Haig ..... F04C 11/008
417/53

* cited by examiner

PUMP

CROSS REFERENCE TO RELATED APPLICATIONS

This non-provisional patent application claims priority under 35 U.S.C. § 119(a) from Patent Application No. 201310196437.2 filed in The People's Republic of China on May 22, 2013. The entire content of the aforementioned patent application is hereby incorporated by reference for all purposes.

FIELD OF THE INVENTION

This invention relates to a pump and in particular to a pump for liquids.

BACKGROUND OF THE INVENTION

Liquid pumps may be found in many different types of machines and applications. For example, many vehicles have a liquid pump used to spray water or a detergent solution onto the windshield or head lamps of the vehicle.

Conventional pumps used in such applications typically comprise a pump housing having a circular cross-section, and a liquid outlet tube extending tangential to the housing. The liquid outlet tube typically is cylindrical in shape and has a constant cross-section. However, while a sufficient amount of liquid may be provided through the outlet tube, the pressure of the liquid may be low. In addition, many conventional liquid pumps, when operating at peak efficiency, will typically output more liquid than is required. Therefore, most conventional liquid pumps are not operated at peak efficiency.

SUMMARY OF THE INVENTION

Hence there is a desire for a more efficient liquid pump. This is achieved in the present invention by forming a diffuser in the outlet from the pump chamber.

Accordingly, in one aspect thereof, the present invention provides a liquid pump, comprising: a pump housing defining a pump chamber; a motor having a shaft and being fixed to the pump housing; an impeller attached to the shaft and accommodated within the pump chamber, the impeller having a central body and a plurality of vanes extending radially outwards from the central body; an inlet in fluid communication with the pump chamber; and an outlet in fluid communication with the pump chamber, the outlet having a first end adjacent to the pump chamber and a second end remote from the pump chamber, wherein a cross-sectional area of the first end $S_1$ is less than a cross-sectional area of the second end $S_2$.

Preferably, radially outer ends of the vanes of the impeller define a circle having a diameter $D_1$ and a radially outer surface of a vane of the plurality of vanes has an axial height of b, wherein the cross-sectional area $S_1$ of the first end of the outlet is defined by $Y\times(\pi b D_1)$, where $0.01\leq Y\leq 0.02$.

Preferably, the first end and the second end of the outlet are separated by a distance L, where $$0.035 \leq \left(\sqrt{\frac{S_2}{\pi}} - \sqrt{\frac{S_1}{\pi}}\right) \Big/ L \leq 0.07.$$

Preferably, radially outer ends of the vanes of the impeller define a circle having a diameter D1, and the pump chamber has a substantially circular cross section having a diameter of DV; where $1.04\leq D_V/D_1\leq 1.1$.

Preferably, the plurality of vanes are uniformly distributed circumferentially around the central body of the impeller.

Preferably, the impeller comprises three vanes.

Preferably, a circumferential width of a vane of the plurality of vanes increases as the vane extends away from the central body.

Preferably, a vane of the plurality of vanes has a rectangular cross section.

Alternatively, a vane of the plurality of vanes has a T-shaped cross section.

Preferably, an end cap is sealingly attached to an inner surface of the pump housing, wherein the pump chamber is defined by an axial surface of the pump housing and the end cap, wherein the motor is disposed within the pump housing and separated from the pump chamber by the end cap, and wherein the shaft extends through the end cap to engage the impeller within the pump chamber.

Preferably, the pump has a ring seal, and a groove is formed in a radially outer surface of the end cap accommodating the ring seal, and the ring seal forms a sealing interface with the inner surface of the pump housing.

Preferably, the end cap has a seal boss with a through hole through which the shaft extends, and wherein a sealing ring is disposed within the seal boss and forms a seal between the end cap and the shaft.

Preferably, the sealing ring comprises an outer portion that contacts the seal boss, and an inner portion that contacts the shaft; wherein the inner portion has a curved surface, such that a first end and a second end of the inner portion contact the shaft, and a central part of the inner portion is spaced from the shaft.

Preferably, the pump chamber has two outlets arranged such that the direction of rotation of the impeller determines through which outlet liquid is pumped.

Preferably, the inlet extends in a direction substantially parallel to an axial direction of the shaft.

Preferably, a portion of the central body of the impeller is accommodated within the inlet.

Preferably, the motor is a DC electric motor.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
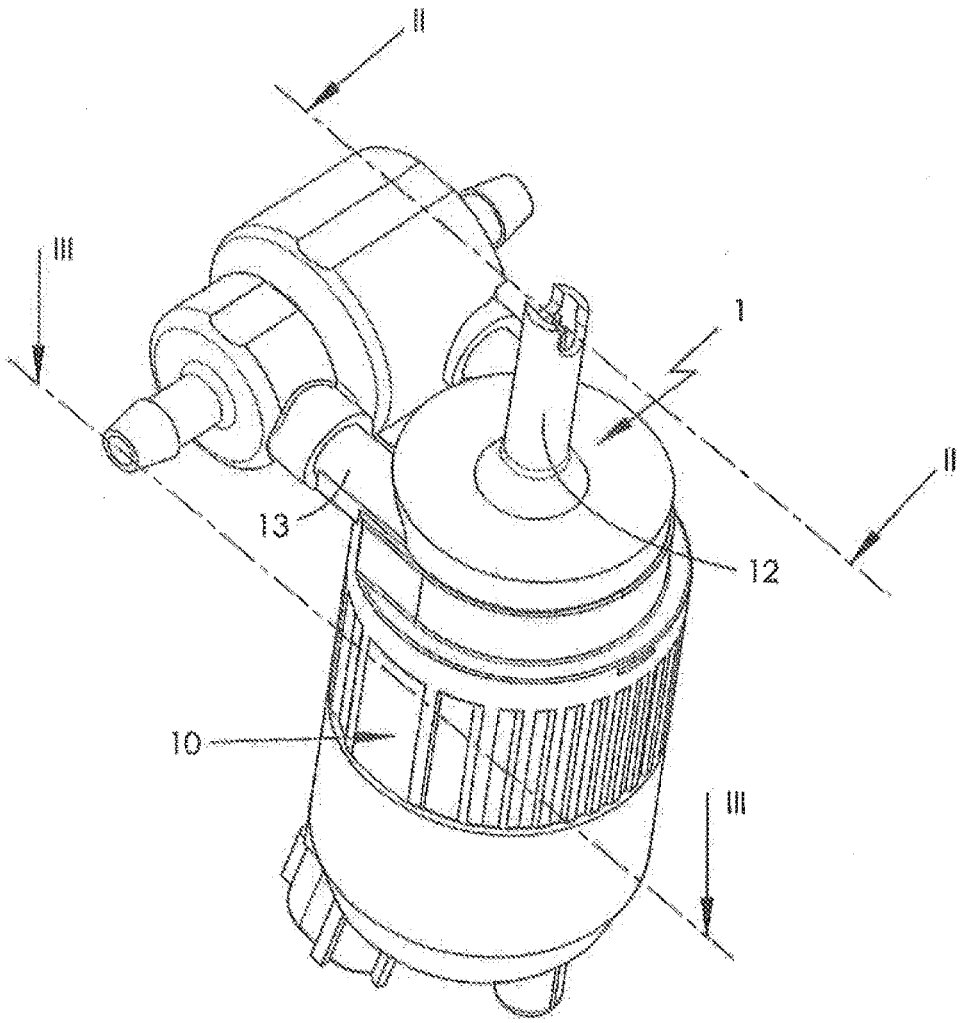
FIG. 1 illustrates a liquid pump according to a preferred embodiment of the present invention.
Figure 2:
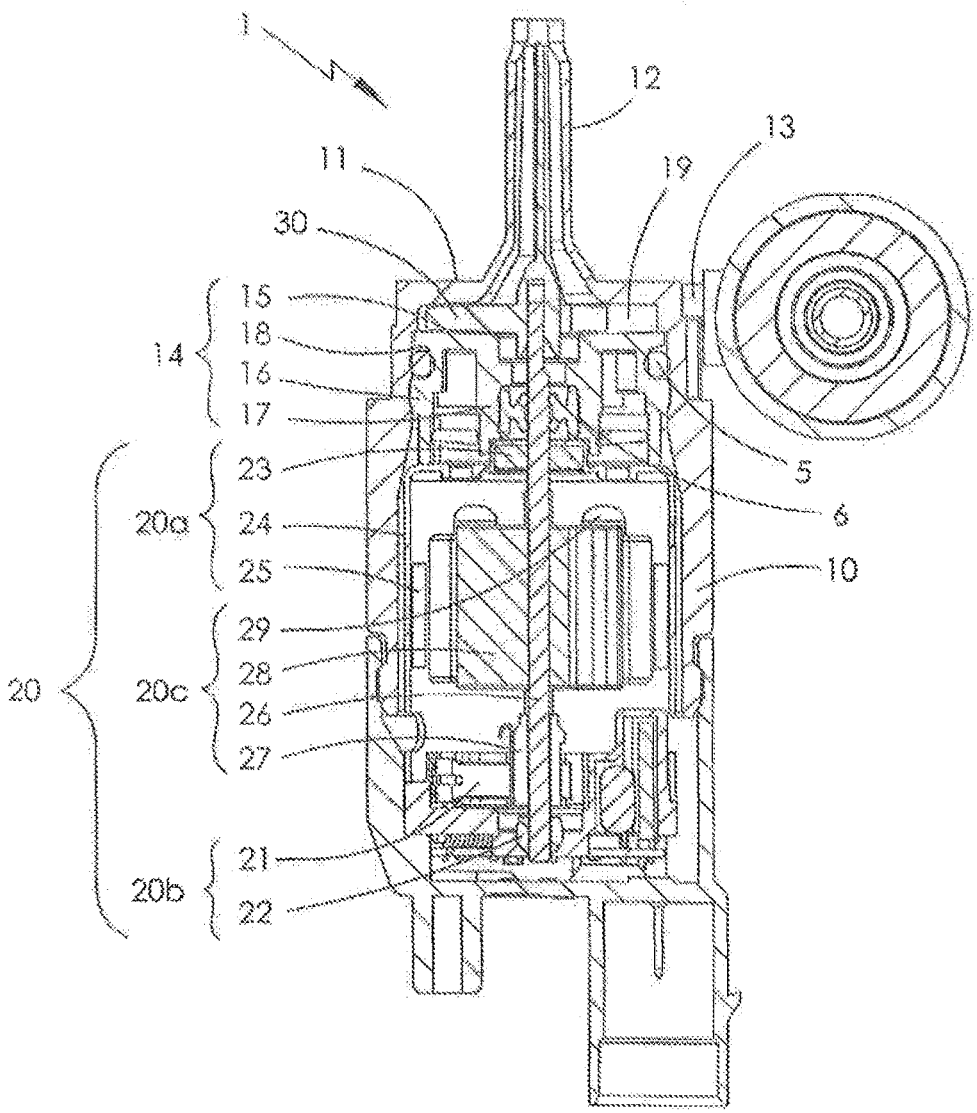
FIG. 2 is a cross-sectional view of the pump of FIG. 1.
Figure 3:
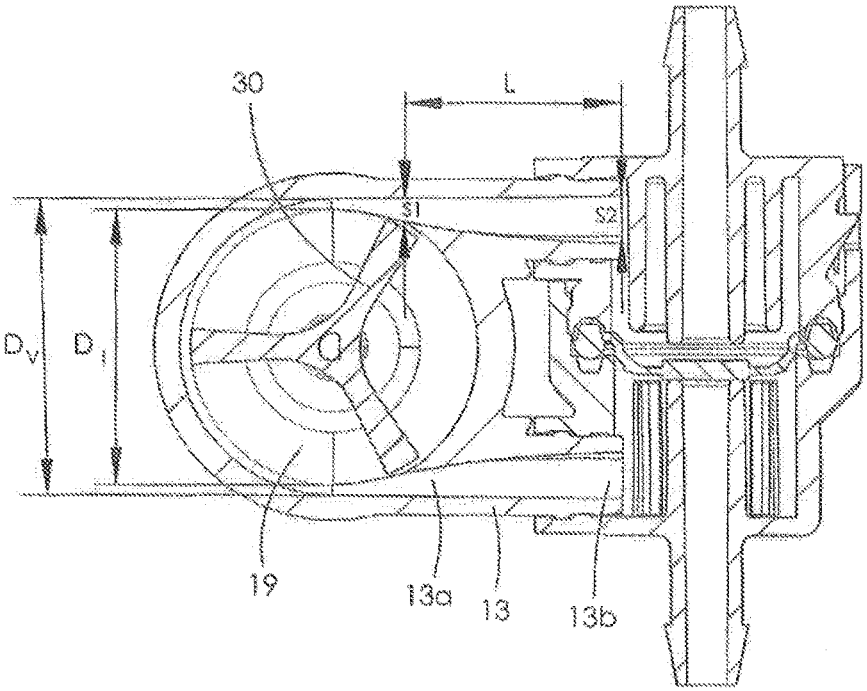
FIG. 3 is another cross-sectional view of the pump of FIG. 1.

FIG. 1 illustrates a liquid pump 1 in accordance with the preferred embodiment of the present invention. FIG. 2 is a cross-sectional view of pump 1 cut along plane (II), and FIG. 3 is a cross-sectional view of pump 1 cut along the plane (III). For ease of explanation, "vertical" or "vertical direction" refers to a direction substantially parallel to an axial direction of pump 1, while "horizontal" or "horizontal direction" refers to a direction substantially perpendicular to the axial direction. However, it is understood that in practice, pump 1 may be oriented in a variety of directions.

Figure 8:
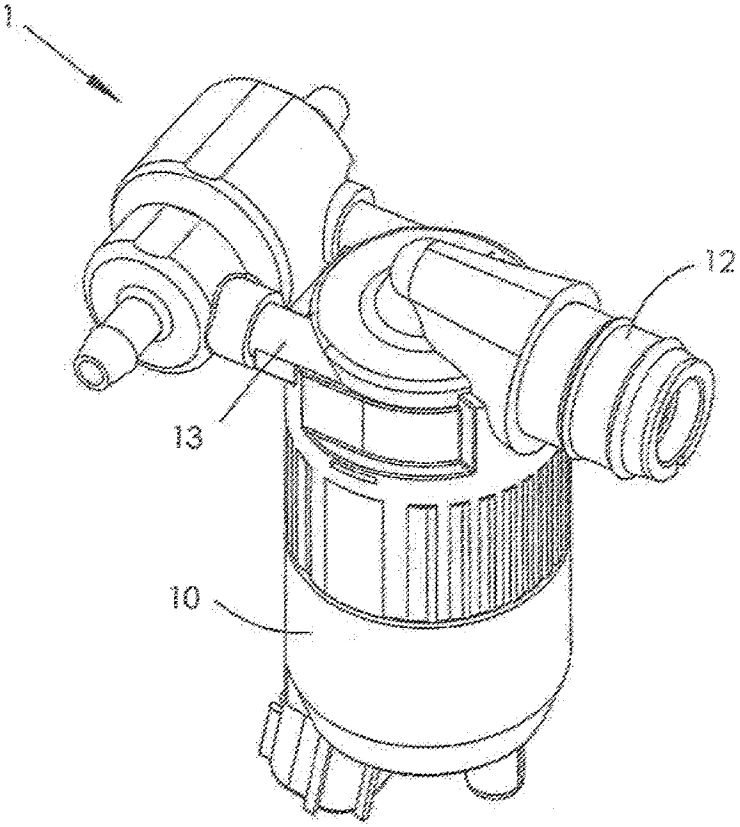
FIG. 8 is a perspective view of a liquid pump in accordance with a second embodiment.

Pump 1 comprises a pump housing 10, an end cap 14 mounted to the housing, a motor 20 fixed inside of the housing, and an impeller 30 configured to rotate with motor 20. Pump Housing 10 and end cap 14 define a substantially cylindrical pump chamber 19 in which the impeller 30 is disposed. An inlet 12 is located on an axial end wall 11 of pump housing 10, and extends away from the housing substantially parallel to an axial direction of the pump. In other embodiments, inlet 12 may extend in other directions. For example, as illustrated in FIG. 8, inlet 12 may extend in a direction substantially perpendicular to an axial direction of the pump. The axial direction of the pump is substantially the same as the axial direction of motor 20.

Figure 9:
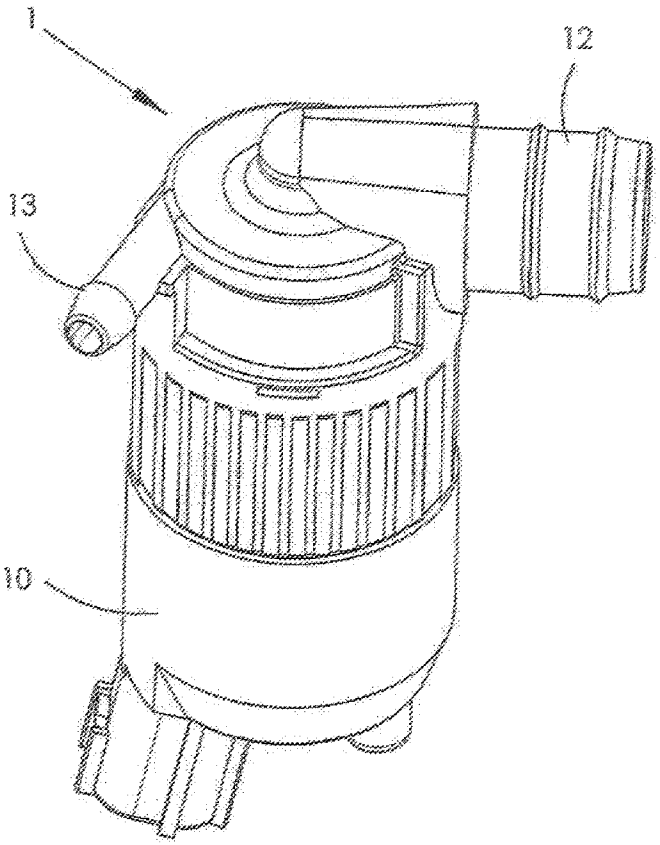
FIG. 9 is a perspective view of a liquid pump in accordance with a further embodiment.

In addition, one or more outlets 13 are located on a sidewall of pump housing 10 near axial end wall 11, extending outwardly in a direction substantially tangential to a circumference of pump 1. In the preferred embodiment, pump 1 has two outlets 13, wherein each outlet 13 corresponds to a different liquid flow path. In other embodiments, as shown in FIG. 9, the pump may have only a single outlet 13.

Outlet 13 comprises a first end 13*a* that connects to pump chamber 19, and a second end 13*b* remote from the pump chamber. First end 13*a* and second end 13*b* may hereinafter be referred to as outlet entrance 13*a* and outlet exit 13*b*, respectively. The cross-sectional areas of outlet entrance 13*a* and outlet exit 13*b* (e.g., sectional area substantially perpendicular to a direction of liquid flow within outlet 13) may be defined as $S_1$ and $S_2$, respectively. $S_2$ is greater than $S_1$ (i.e., $S_2>S_1$) in order to form the diffuser. In the preferred embodiment, outlet 13 gradually increases in cross-sectional area along the direction of liquid flow from $S_1$ to $S_2$.

Figure 4:
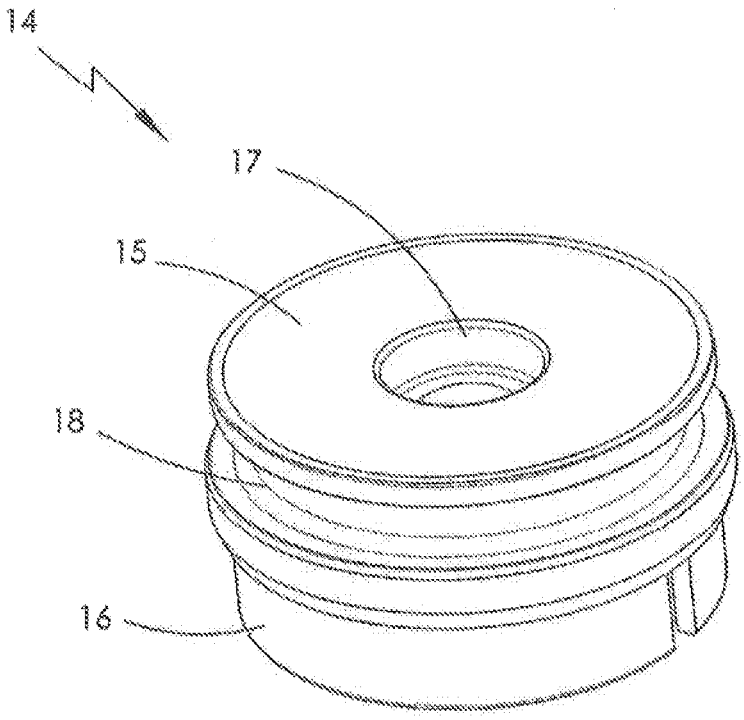
FIG. 4 illustrates an end cap used in the pump of FIG. 1.
Figure 5A:
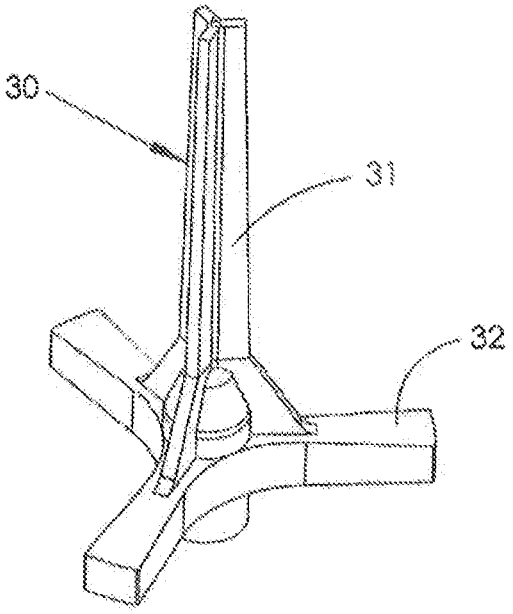
FIGS. 5A, 5B, and 5C are a perspective view, plan view and side view of an impeller used in the pump of FIG. 1.
Figure 5B:
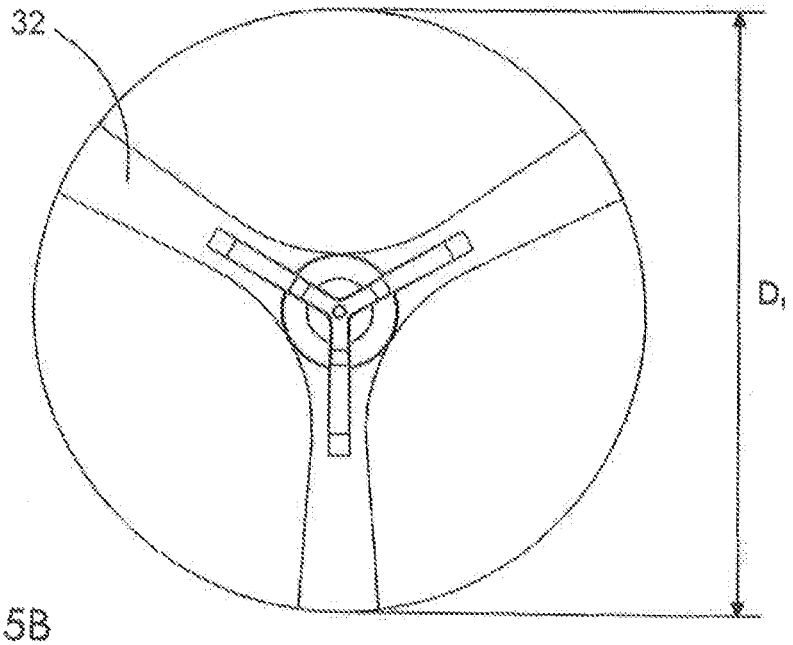
Figure 5C:
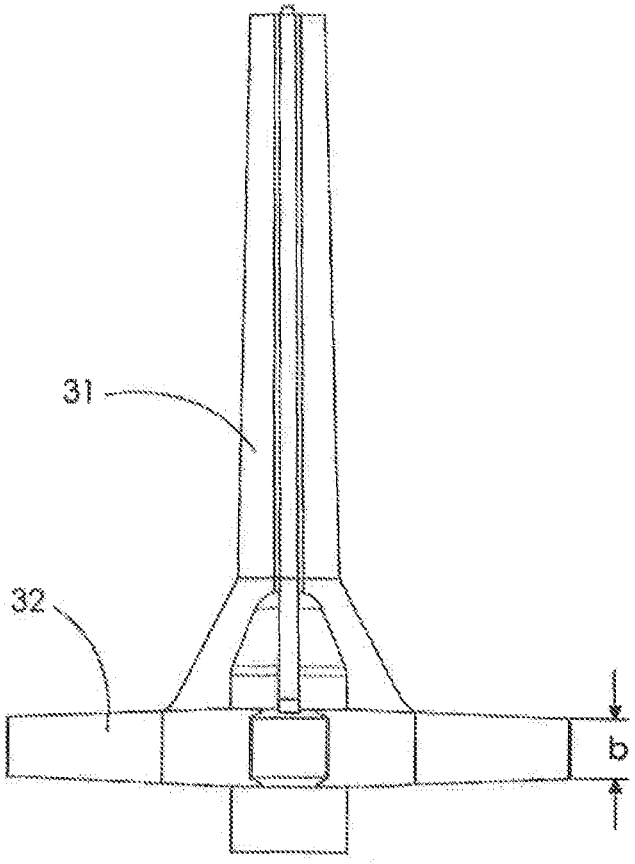

FIG. 4 illustrates the end cap 14 used in the preferred embodiments. End cap 14 has, on one side which faces the impeller, a substantially flat end surface 15. A sidewall 16 extends in an axial direction from a radially outer edge of end surface 15, forming a radially outer surface of the end cap. A seal boss 17 is formed by a central through hole extending axially and inwardly from end surface 15. Sidewall 16 has a groove 18 that extends circumferentially around sidewall 16. Groove 18 accommodates a ring seal 5 which forms a sealing interface with an inner surface of pump housing 10 when the end cap is attached to the pump housing. Preferably, ring seal 5 is a rubber O-ring. End cap 14 thus defines one end of pump chamber 19, i.e. pump chamber 19 is formed in pump house 10 between axial end wall 11 and end cap 14.

Figure 7:
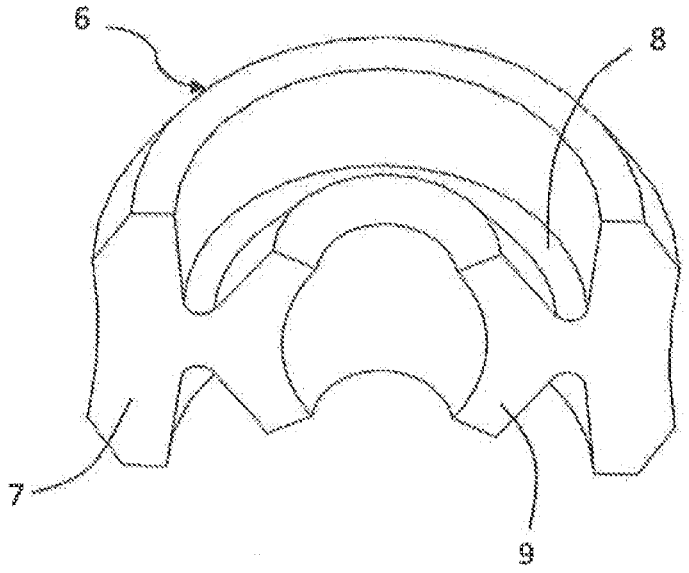
FIG. 7 is a sectional view of a seal used in the pump.

Seal boss 17 of end cap 14 accommodates a sealing ring 6, through which shaft 26 of motor 20 extends in order to connect with the impeller. During operation, as shaft 26 rotates it maintains contact with sealing ring 6, preventing liquid within chamber 19 from reaching motor 20. Preferably, as illustrated in FIG. 7, sealing ring 6 comprises an outer ring 7, an inner ring 9, and a connecting ring 8 disposed between and interconnecting outer ring 7 and inner ring 9. Preferably, inner ring 9 is curved or part spherical in shape (e.g., the axial ends of inner ring 9 curve or slant inwards from a central portion of inner ring 9), such that the axial ends of inner ring 9 are in contact with shaft 26, while a space is formed between a central portion of inner ring 9 and shaft 26. Thus the seal forms two sealing interfaces with the shaft and the space between may be used for lubricant to lubricate the sealing interfaces.

Motor 20 is fixed to pump housing 10 on a side of end cap 14 remote from chamber 19. Motor 20 may be a direct current (DC) electric motor, comprising a stator 20*a*, an end plate 20*b*, and a rotor 20*c*. Stator 20*a* comprises a motor housing 24 and a plurality of permanent magnets 25 accommodated within housing 24 (e.g., mounted on an inner surface of housing 24). In addition, housing 24 may form a bearing retainer located at an axial end thereof. Stator 20*a* further comprises a bearing 23 mounted in the bearing retainer. End plate 20*b* is fixed to and closes an open end of housing 24. End plate 20*b* supports a plurality of electric brushes 21 and a second bearing 22. Rotor 20*c* comprises shaft 26, a commutator 27 and a rotor core 28 fixed to shaft 26. A plurality of winding coils 29 are wound around rotor core 28 and connected to commutator 27, which is arranged to be in sliding contact with brushes 21. Shaft 26 is journalled in bearings 22,23 so that rotor 20*c* is able to rotate with respect to stator 20*a*. During operation, electric current travels through electric brushes 21 to commutator 27, energizing winding coils 29 and causing rotor 20*c* to rotate within stator 20*a*.

While the above-described motor 20 is a brushed DC motor, it is understood that in other embodiments, other types of motors may be used, such as a brushless DC motor, alternating current (AC) motor, or any other mechanical apparatus capable of producing rotary motion.

FIGS. 5A-5D illustrate the preferred impeller 30 used in the pump of FIG. 1. Impeller 30 comprises a body 31 extending in an axial direction, and a plurality of vanes 32 extending radially from body 31. Impeller 30 is disposed within chamber 19 and mounted to shaft 26 of motor 20, such that it rotates with shaft 26. Optionally, a portion of body 31 is accommodated within inlet 12. In the illustrated embodiment, impeller 30 has three vanes 32 uniformly distributed circumferentially around body 31, although it is understood that in other embodiments, impeller 30 may comprise any number of vanes 32.

As shown, vanes 32 have a square or rectangular cross section, with a circumferential width that gradually increases as vane 32 extends away from body 31. A radially outer surface of vanes 32 has a height b in the axial direction. As impeller 30 rotates, vanes 32 define a circle having a diameter $D_1$.

During operation of pump 1, impeller 30 rotates with shaft 26. Liquid flows through inlet 12 into chamber 19, and is propelled by the rotating impeller 30 to outlet entrance 13*a*, where it exits pump housing 10 through outlet exit 13*b*. Due to the increasing cross-sectional area between outlet entrance 13*a* and outlet exit 13*b*, outlet 13 forms a diffuser as liquid flows from outlet entrance 13*a* to outlet exit 13*b*. Within the diffuser, kinetic energy of the liquid flowing within is converted to pressure, raising the pressure of the liquid flow. In embodiments having two outlets 13, such as the preferred embodiment of FIGS. 1-3, the direction of rotation of impeller 30 may be used to select the outlet 13 through which liquid will be pumped.

The side surfaces of vanes 32 play a major role in moving liquid through outlets 13 as vanes 32 rotate. The larger the side surfaces of vanes 32, the greater the amount of liquid that can be pumped in a given period of time. However, in order for pump 1 to operate efficiently, the cross-sectional area S1 of outlet entrance 13*a* should be configured based upon the amount of water propelled by vanes 32. For example, if S1 is too large, the space created in outlet entrance 13*a* will not be sufficiently utilized. However, if S1 is too small, not all of the liquid propelled by vanes 32 will be able to enter outlet 13. Thus, the preferred size of the cross-sectional area S1 of outlet entrance 13*a* of outlet 13 is define by $S1=Y\times(\pi bD_1)$, where $0.01\leq Y\leq 0.02$.

Figure 6B:
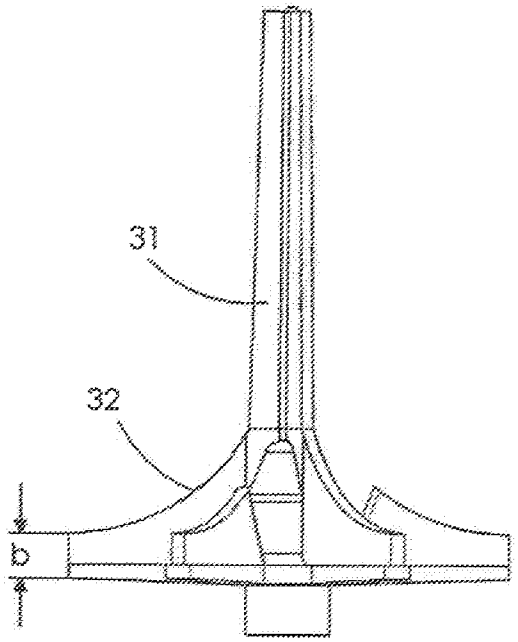
FIGS. 6A and 6B illustrate perspective and side views of an alternative impeller.
Figure 6A:
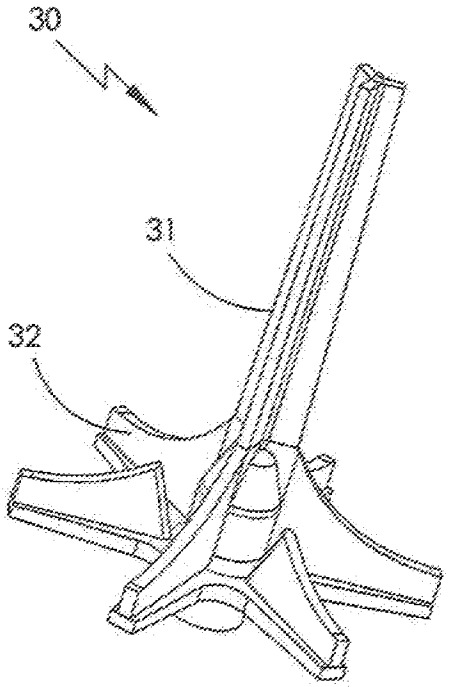

It is understood that the shape of vanes 32 is not limited to that described above or shown in FIGS. 5A-C. For example, FIGS. 6A and 6B illustrate an alternative impeller 30 in accordance with a second embodiment. In this embodiment, vanes 32 have a cross-section that is substantially T-shaped (e.g., having a central portion that extends beyond a pair of side portions), wherein an axial height of an outer surface of vanes 32 is defined as b.

The diffuser has a diffusion coefficient $C_d$, which may be defined by the formula $$C_d=\left(\sqrt{\frac{S_2}{\pi}}-\sqrt{\frac{S_1}{\pi}}\right)\Big/L,$$

where L corresponds to a distance between outlet entrance 13*a* and outlet exit 13*b*. When $C_d$ is too small, the diffusion effect may not be sufficient. On the other hand, $C_d$ being too large may lead to increased separation of the liquid flow, to the detriment of liquid pressure. In some embodiments, cross-sectional areas $S_1$ and $S_2$ are defined by $0.035\leq C_d\leq 0.07$, in order to achieve a desirable diffusing effect.

In addition, the ratio of the diameter of chamber 19 $D_V$ to the diameter $D_1$ defined by vanes 32 may also be an important consideration. For example, if the ratio $D_V/D_1$ is too small, the gap between vanes 32 and the sidewall of chamber 19 will be too small, causing a liquid flow rate that is too high, with high losses due to friction. However, if $D_V/D_1$ is large, then a smaller $D_1$ is needed, lowering the efficiency of the pump. Preferably, the size of impeller 30 relative to pump chamber 19 is defined by $1.04\leq D_V/D_1\leq 1.1$.

In the description and claims of the present application, each of the verbs "comprise", "include", "contain" and "have", and variations thereof, are used in an inclusive sense, to specify the presence of the stated item but not to exclude the presence of additional items.

Although the invention is described with reference to one or more preferred embodiments, it should be appreciated by those skilled in the art that various modifications are possible. Therefore, the scope of the invention is to be determined by reference to the claims that follow.

The invention claimed is:

1. A liquid pump, comprising:

a pump housing defining a pump chamber;

a motor having a shaft and being fixed to the pump housing;

an impeller attached to the shaft and accommodated within the pump chamber, the impeller having a central body and a plurality of vanes extending radially outwards from the central body;

an inlet in fluid communication with the pump chamber;

at least one outlet in fluid communication with the pump chamber and extending outwardly in a direction substantially tangential to a circumference of the pump chamber, the outlet having a first end connected to the pump chamber and a second end farthest away from the pump chamber, the outlet gradually increasing in cross-sectional area along the direction of liquid flow from the first end to the second end to form a diffuser, and an end cap sealingly attached to an inner surface of the pump housing;

wherein a cross-sectional area of the first end $S_1$ is less than a cross-sectional area of the second end $S_2$;

wherein the pump chamber is defined by an axial surface of the pump housing and the end cap, the motor is disposed within the pump housing and separated from the pump chamber by the end cap, the shaft extends through the end cap to engage the impeller within the pump chamber;

wherein the end cap has a seal boss with a through hole through which the shaft extends, a sealing ring is disposed within the through hole of the seal boss and sandwiched between the end cap and the shaft to serves as a seal between the pump housing and the pump chamber, wherein the first end and the second end of the outlet are separated by a distance L, where $0.035\leq(\sqrt{S_2/\pi}-\sqrt{S_1/\pi})/L<0.07$.

2. The liquid pump of claim 1, wherein radially outer ends of the vanes of the impeller define a circle having a diameter $D_1$ and a radially outer surface of a vane of the plurality of vanes has an axial height of b, wherein the cross-sectional area $S_1$ of the first end of the outlet is defined by $Y\times(\pi bD_1)$, where $0.01\leq Y\leq 0.02$.

3. The liquid pump of claim 1, wherein radially outer ends of the vanes of the impeller define a circle having a diameter $D_1$, and the pump chamber has a substantially circular cross section having a diameter of $D_V$;

where $1.04\leq D_V/D_1\leq 1.1$.

4. The liquid pump of claim 1, wherein the plurality of vanes are uniformly distributed circumferentially around the central body of the impeller.

5. The liquid pump of claim 1, wherein the impeller comprises three vanes.

6. The liquid pump of claim 5, wherein a circumferential width of a vane of the plurality of vanes increases as the vane extends away from the central body.

7. The liquid pump of claim 5, wherein a vane of the plurality of vanes has a rectangular cross section.

8. The liquid pump of claim 5, wherein a vane of the plurality of vanes has a T-shaped cross section.

9. The liquid pump of claim 1, further comprising a ring seal, wherein a groove is formed in a radially outer surface of the end cap accommodating the ring seal, and the ring seal forms a sealing interface with the inner surface of the pump housing.

10. The liquid pump of claim 1, wherein the sealing ring comprises an outer portion that contacts the seal boss, and an inner portion that contacts the shaft;

wherein the inner portion has a curved surface, such that a first end and a second end of the inner portion contact the shaft, and a central part of the inner portion is spaced from the shaft.

11. The liquid pump of claim 1, wherein said at least one outlet of the pump chamber has two outlets arranged such that the direction of rotation of the impeller determines through which outlet liquid is pumped.

12. The liquid pump of claim 1, wherein the inlet extends in a direction substantially parallel to an axial direction of the shaft.

13. The liquid pump of claim 12, wherein a portion of the central body of the impeller is accommodated within the inlet.

14. The liquid pump of claim 1, wherein the motor is a DC electric motor.

15. A liquid pump, comprising:

a pump housing defining a pump chamber;

a motor having a shaft and being fixed to the pump housing;

an impeller attached to the shaft and accommodated within the pump chamber, the impeller having a central body and a plurality of vanes extending radially outwards from the central body;

an inlet in fluid communication with the pump chamber;

at least one outlet in fluid communication with the pump chamber and extending outwardly in a direction substantially tangential to a circumference of the pump chamber, the outlet having a first end connected to the pump chamber and a second end farthest away from the pump chamber, the outlet gradually increasing in cross-sectional area along the direction of liquid flow from the first end to the second end to form a diffuser, wherein a cross-sectional area of the first end $S_1$ is less than a cross-sectional area of the second end $S_2$, the first end and the second end of the outlet are separated by a distance L, where $0.035 \leq (\sqrt{S_2/\pi} - \sqrt{S_1/\pi})/L \leq 0.07$.

16. The liquid pump of claim 15, wherein radially outer ends of the vanes of the impeller define a circle having a diameter $D_1$ and a radially outer surface of a vane of the plurality of vanes has an axial height of b, wherein a cross-sectional area $S_1$ of the first end of the outlet is defined by $Y \times (\pi b D_1)$, where $0.01 \leq Y \leq 0.02$.

* * * * *